United States Patent [19]

Seragnoli

[11] 3,984,963

[45] Oct. 12, 1976

[54] DEVICE FOR SEALING OVERWRAPS OF PACKAGES

[75] Inventor: Enzo Seragnoli, Bologna, Italy

[73] Assignee: G. D. Societa per Azioni, Italy

[22] Filed: June 24, 1975

[21] Appl. No.: 589,879

[30] Foreign Application Priority Data

July 10, 1974 Italy ..... 3437/74

[52] U.S. Cl. ..... 53/77; 53/379; 156/359; 156/583

[51] Int. Cl.[2] ..... B65B 51/14

[58] Field of Search ..... 53/379, 373, 203, 229, 53/329, 77, 375; 156/583, 358, 359, 306

[56] References Cited

UNITED STATES PATENTS

| | | | |
|---|---|---|---|
| 3,431,398 | 3/1969 | Wahle | 53/379 X |
| 3,692,611 | 9/1972 | Kühnle | 156/358 |

*Primary Examiner*—Othell M. Simpson
*Assistant Examiner*—Horace M. Culver
*Attorney, Agent, or Firm*—Robert E. Burns; Emmanuel J. Lobato; Bruce L. Adams

[57] ABSTRACT

A device for controlling the sealing of seams of thermoplastic overwraps for packets of cigarettes. A wrapping wheel has a plurality of sealing stations for heat-sealing one single seam of the overwrap of each packet. In each station a heat-sealing contrivance can contact the seam during a halt of the wheel. The total contact time, that is, the sum of the individual times of contact between the several sealing contrivances and the overwrap, is controlled in response to the operating speed of the machine. For this purpose the several sealing contrivances, each connected for a reciprocating motion, are installed, one in each sealing station, and have a control system sensitive to variations in the operating speed of the machine, to trip the means for reciprocating them individually, to suit different speed levels of the machine.

7 Claims, 2 Drawing Figures

DEVICE FOR SEALING OVERWRAPS OF PACKAGES

BACKGROUND OF THE INVENTION

This invention relates to wrapping or packaging machines and, in particular, to what are known as overwrapping machines.

DESCRIPTION OF THE PRIOR ART

For reasons of hygiene, as well as to render their appearance more pleasing, packets of cigarettes are over wrapped and sealed in sheets of transparent material.

This is generally done using the style of wrap known as the "soap" style and according to the known art, this includes the hermetic sealing of on one longitudinal side of each packet.

The classic wrapping materials used on machines that overwrap the aforementioned products consist of a transparent viscous support on both sides of which there is a layer of fluid resistant lacquer, such as, for example, the material marketed under the trade mark "Cellophane".

Insofar as such materials are concerned, the sealing operation is performed by applying solvent or adhesive in the given areas, or through a heatsealing process to which only the outer layers of lacquer are subjected.

For some time now, however, increasing use has been made on the overwrapping machines of a different plastic, heat-sealing wrapping material produced with an extrusion process (polypropylene), such as, for example, that marketed by Hercules, Inc., Wilmington, Delaware under the name "Hercules" which, in comparison with the materials mentioned earlier on, offers numerous advantages.

This type of material can be obtained in webs of a gage notably less than that of materials of traditional type and since it is, in itself, already impervious to moisture, it does not have to be given any costly lacquering treatment.

Besides being a financially attractive proposition, when this material is used on overwrapping machines in reels of the same size as for materials previously used, it lasts much longer than the latter.

The use of this type of material on known machines in accordance with traditional methods can, however, cause certain difficulties to arise.

This type of heat-sealing wrapping material for which no solvents or adhesives are used requires, in fact, the temperature to be controlled with precision during the sealing operation. This is because the working temperature for heatsealing polypropylene (approximately 125°–165°C) is relatively limited.

Aside from the temperature limits various problems are encountered. In the first place there is the phenomenon of the material shrinking considerably and of the consequential formation of ugly folds which, in the case of packets of what are called the "soft cup" type, cause crushing because of the contraction the overwrap undergoes.

According to what is known, the temperature reached in the areas affected by the sealing operation depends on the temperature of the sealing contrivances, the pressure exerted by them, and the duration of the contact time.

In the particular case of overwrapping machines for the use described above which, as is known, operate at different running speeds, the contact time is chosen and fixed in a way in which to achieve fully successful sealing operations at the rated speed of the overwrapping machine.

The sealing contrivance generally takes its movement from the same devices that power the overwrapping machine. It follows that any possible variation in the working rhythm of the overwrapping machine gives rise to a variation in the contact time between the sealing contrivances and the outer wrap, and to a resulting variation of the sealing temperature.

In the extreme case of the overwrapping machine coming to a stop, it is known to provide for automatic removal of the sealing contrivances away from the area in which they operate. It is necessary also to prevent the packets, with which the sealing contrivances come into contact, from getting burnt when the machine operates, for example when starting up or in cases of emergency, at speed levels below the rated speed. The increased time the plastic material is in contact with the sealing contrivances can bring about the difficulties mentioned above.

In order to overcome trouble of this nature, the idea is known of controlling the sealing of wraps by varying the heat source of a sealing contrivance, as changes occur in the running speed of the overwrapping machine and consequentially in the contact time. This generally requires a plurality of electrical resistors sized to suit the various speeds at which the machine can operate, so that they can be switched in at the operating position when a change in the operating speed of the machine occurs.

It is also known to provide a device for controlling the movement of a sealing contrivance, connected to the mechanism provided for changing over the speed at which the machine is running, and able to either prolong or curtail the operation of the sealing contrivance.

SUMMARY OF THE INVENTION

The primary object of the present invention is to improve a machine of the aforementioned type by providing, along the wrapping line, a plurality of sealing stations for one single overwrap portion or seam to be sealed on each individual product, and thereby to keep the total contact time, that is to say the sum of the individual contact times between the sealing contrivances and the heat-sealing material substantially uniform regardless of whether the machine runs at its rated speed.

Another object of the present invention is, in conformity with the previous object, to determine the contact times between the heat-sealing material and the individual sealing contrivances in such a way as to obtain, by cutting off one or more of the sealing contrivances, a total contact time constant for all speed levels of the machine.

These and other objects have been attained by providing a plurality of stations in which sealing contrivances are connected to means that cause them to operate with a reciprocating motion; means which are sensitive to variations in the operating speed levels of the machine and which trip the means for operating the sealing contrivances so that the sealing action of part of the sealing contrivances is either put into or out of operation to suit the individual operating speed levels detected by the means that are sensitive to variations therein.

DESCRIPTION OF THE PREFERRED EMBODIMENT

Figure 1:
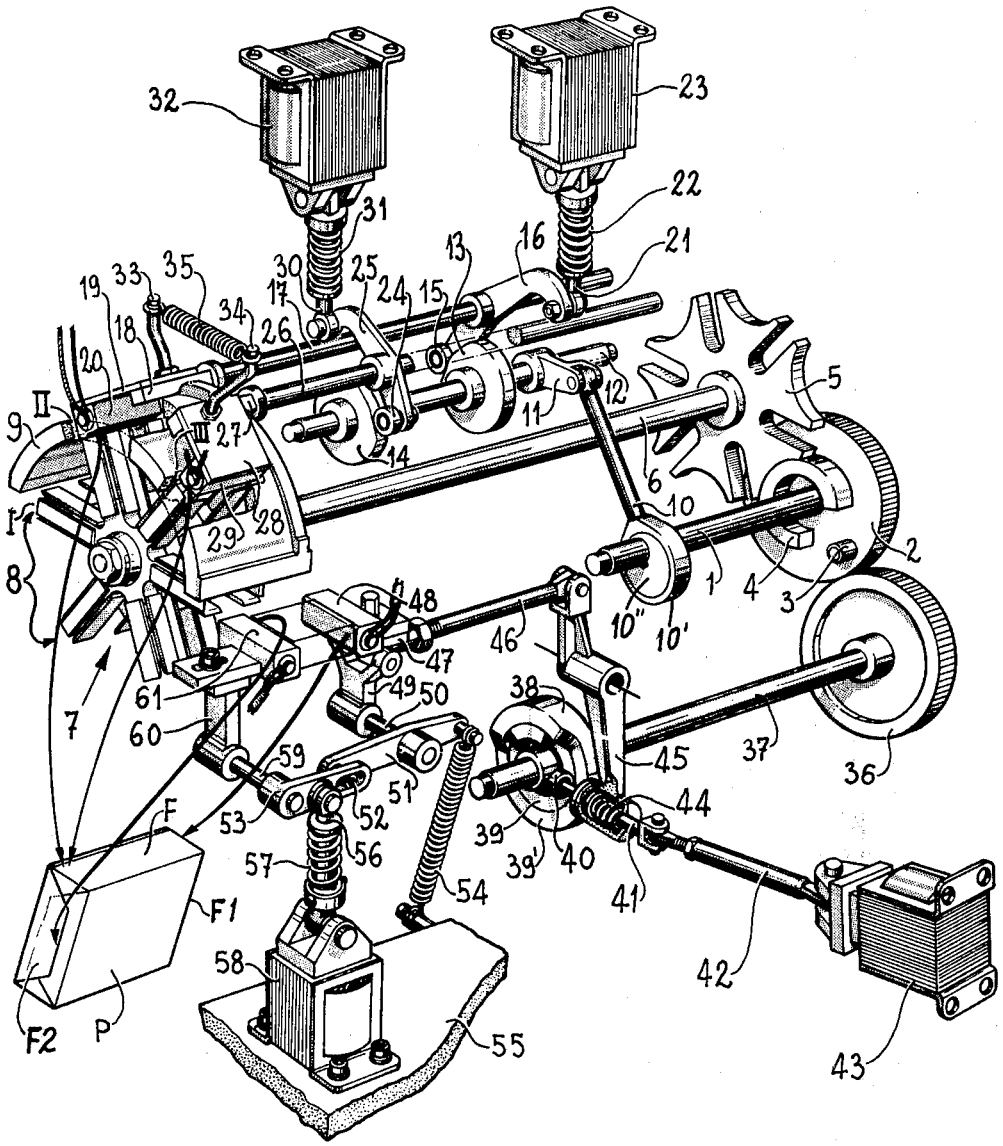
FIG. 1 shows diagrammatically, in a perspective view, the wrapping line of an overwrapping machine with the devices for controlling the sealing of the side of each packet, according to the invention.

With particular reference to FIG. 1 a horizontal drive shaft 1 is provided to power the overwrapping machine including the device according to the invention.

The shaft 1 has keyed onto it a gearwheel 2 and on one side of this, diametrically opposed to each other, are fixed a pin or idle roller 3 and an arcuate member or centering device 4. Those members 3 and 4 bring about an intermittent movement of a six compartment Geneva mechanism 5 rigidly mounted on a horizontal shaft 6 to the front end of which is fixed a packet-transferring means 7 such as a wrapping wheel. This transferring means or wheel accordingly completes one forward movement or step 60° clockwise, followed by a halt, each time the shaft 1 makes one full counterclockwise turn.

The wrapping wheel 7 has six radial compartments 8. When one of these, at a halt of wheel 7 is at a first station I, a packet P of cigarettes is inserted therein, on edge with respect to the axis of wheel 7, along with a sheet of transparent material for the formation of the outer wrap.

Two ends of the sheet of wrapping material that protrude radially from the wheel 7 are then folded onto an external side surface of the packet by stationary and movable folding members as indicated in FIG. 1.

A guide 9 delimitates the upper part of the wheel 7 for approximately 180°.

An end of a connecting rod 10 is shown as secured to a sleeve 10′ which surrounds an eccentric disc 10″ secured to shaft 1, whilst its big end is fastened to one extremity of a lever 11. The other extremity of lever 11 is secured to a shaft 12 parallel with the shaft 1 for oscillating this shaft around its axis.

From right to left, looking at FIG. 1, the shaft 12 has keyed onto it first and second cams 13 and 14.

An idle roller 15 turns on a horizontal pin carried at one end of a two armed lever 16 pivoted to a shaft 17 parallel with the shaft 12, and runs along the profile of the cam 13.

A horizontal bar 18 is fixed to the lefthand far end of the shaft 17 and extends transversely above the guide 9 to support a rectangular plate 19.

The plate 19 supports, at a point corresponding to where an aperture exists in the guide 9 above a station II positioned at 60° from the station I, a first electrically heated sealing member 20.

The extremity of the second arm of the two armed lever 16 is connected to the lower end of a vertical rod 21 integral with the keeper of an electromagnet 23 and biased downwardly by a spring 22.

In exactly the same way as described in respect of the first cam 13, and idle roller 24 turns on a horizontal pin carried at one end of a two armed lever 25 pivoted to a shaft 26 parallel with the shaft 12, and runs along the profile of the cam 14; a horizontal bar 27 is fixed to the lefthand far end of the shaft 26 and extends transversely above the guide 9 to support a rectangular plate 28; the plate 28 supports, at a point corresponding to where an aperture exists in the guide 9 above a station III for the wheel 7, positioned at 120° from the station I, a second electrically heated sealing member 29; and the extremity of the second arm of the two armed lever 25 is connected to the lower end of a vertical rod 30 integral with the keeper of an electromagnet 32 and biased downwardly by a spring 31.

Fixed onto the heater supporting 19 and 28 are bars 33 and 34, respectively, the upper ends of which are connected to each other through a spring 35 which is under tension and offsets the action of the electromagnets 23 and 32.

Under normal operating conditions, that is to say, when the overwrapping machine is running at its rated speed, which is its second speed, both the electromagnets 23 and 32 are excited and, consequently, the two idle rollers 15 and 24 run along the profiles of the cams 13 and 14, respectively.

The conformation of these profiles is such that each time the wheel 7 is at a standstill, the sealing members 20 and 29 are made to approach the external sides F of the two packets of cigarettes P positioned in the vicinity of station II and station III, respectively, and subsequently to move away therefrom.

Sealing of the side F on the transparent thermoplastic wrap thus takes place for each packet, at the rated speed, in two separate phases, namely, an initial phase in station II performed by the first sealing member 20 and then a final phase, performed by the second sealing member 29 in station III, for sufficiently long a contact time to allow the operation to be carried out perfectly.

Let it now be assumed that the overwrapping machine is operating at a value below its rate speed, or a first speed which, as is known, can happen when the machine is being started up or also in cases of emergency.

Under these particular conditions the drive shaft 1 rotates at a speed below that previously considered. The result is that the total contact time between the surfaces of the sealing members 20, 29 and the individual sheets of transparent material is lengthened to the extent that it gives rise, bearing in mind the restricted temperature limits permissible for the materials under consideration, to the various annoyances described in the opening paragraphs hereof.

For this reason the electrical control circuit for the overwrapping machine (FIG. 2) is set in such a way as to cut off one of the two sealing members through the automatic drop out of the respective electromagnet, for example 32, when the slow running conditions are experienced. At the same time the cam for the other sealing member is provided with a profile with which it is possible to generate, under the slow-speed conditions, a contact time which is sufficiently long to guarantee the sealing operation being perfectly successful.

The de-energizing of the electromagnet 32 is followed by the sealing member 29 being immediately lifted away from the area in which it works, and by its rotating around the shaft 26 under the joint action of the springs 31 and 35.

In the event of the overwrapping machine coming to a stop for any reason, both electromagnets 23 and 32 drop out automatically and thus both sealing members 20 and 29 are lifted away from the areas in which they work.

After the sealing operation described is over, the areas corresponding to the two ends on each packet still have to be sealed, in order to complete the sealing of the outer wrap as described in the copending patent application, Ser. No. 589,878. Briefly, this is done as follows.

Through the gearwheel 2, the drive shaft 1 rotates a gear 36 keyed onto a shaft 37 parallel with the shaft 1, the lefthand far end of the former being integral with a cam 38, on the front side of which there are two tracks, 39 and 39'. While the overwrapping machine is running at its rated speed, the inner track 39 has running over it an idle roller 40 rotatably mounted on a horizontal rod 41. This rod is connected, via a rod 42, to the keeper of an electromagnet 43 which is in a state of excitation.

The rod 41 extends through a hollow end of one of the arms of a two armed lever, 45, in such a way that it is able by lateral displacement of the shaft to rock the lever, as indicated by the drawing, while being able to slide axially from left to right with respect to the hollow end. Such sliding takes place in the case of the said electromagnet 43 being de-energized, by the action of the spring 44, the two ends of which are connected to the rod 41 and to the hollow end of the two armed lever 45, respectively. In the considered case of the machine operating at its rated speed, the spring is stretched.

The second arm of the two armed lever 45 is connected, through a rod 46, to a block 47 for supporting an electrically heated sealing member 48 for the rear end F1 of packet P.

The block 47 is also connected, through a lever 49, to a horizontal shaft 50 parallel with an exiting channel of wheel 7. Shaft 50 serves as a pivot for a two armed lever 51 with which it is integral, or to which it is secured, as shown.

The front arm (on the left looking at FIG. 1) on the two armed lever 51 is provided with a pin 52 which is horizontal and is inserted in a slot in one end of a lever 53. The rear arm is connected, via a spring 54, to a plate 55 integral with the bedplate of the overwrapping machine.

The lever 53 is pivoted, at an intermediate point, to the upper extremity of a vertical shaft 56 connected to the keeper of an electromagnet 58 mounted on the bed plate 55. The lever is biased upwardly by a spring 57, against a downward force applied to the lever when the electromagnet 58 is excited.

The second extremity of the lever 53 is integral with a shaft 59 parallel with the shaft 50 and integral with a block 60 for supporting an electrically heated sealing member 61 for the front end F2 of packet P.

Through the described mechanical connections, the cam 38 causes the sealing members 48 and 61 to simultaneously approach, in a direction crosswise to the exiting channel and during each of the halts of wheel 7, the ends F1 and F2, respectively, on each packet P of cigarettes and then to move away therefrom at the time the packet is moved forward through the exciting channel.

Figure 2:
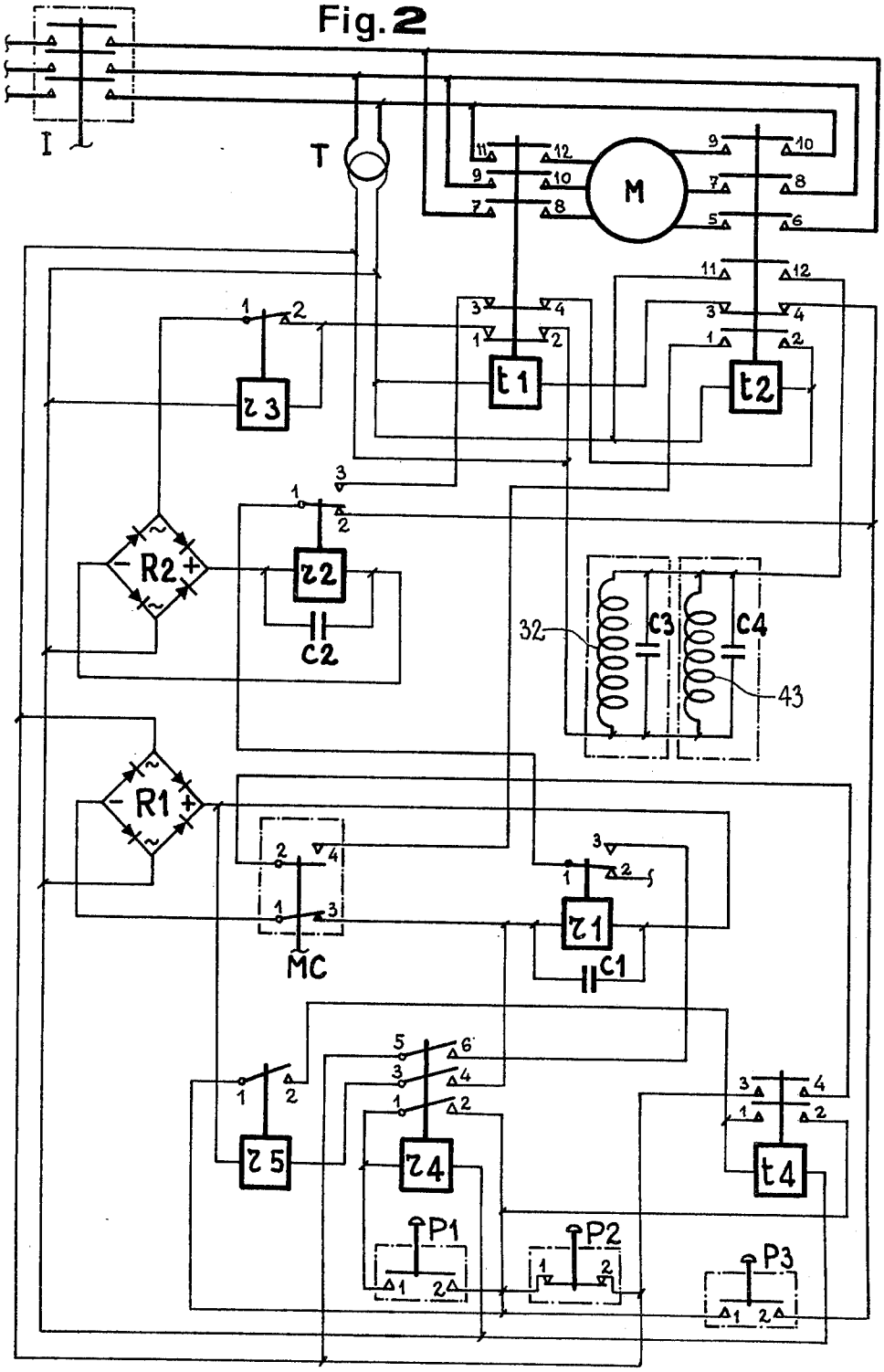
FIG. 2 shows diagrammatically the electrical control circuit for the overwrapping machine in FIG. 1.

When the machine is being started up, or for some emergency reason is running at a speed below its rating, the electromagnet 43 is, as described in the aforementioned patent application, and as can be seen from the wiring diagram in FIG. 2, automatically de-energized.

As a consequence of the pull exerted on the rod 41 by the spring 44, the idle roller 40 is then carried onto the outer track 39' of the cam 38.

On track 39', a raised section is provided for moving linkage 45 or 60 so that the sealing members 48 and 61 are moved away from their respective operating areas, and this section, as shown, extends for a greater number of degrees than is the case with the inner track 39.

Reference will now be made to the aforementioned FIG. 2 in which the electrical circuit is shown for the motor M of drive shaft 1 and the principal electromagnets. A microswitch MC is provided at a point where the packets of cigarettes to be overwrapped enter the overwrapping machine. At the first speed, the microswitch has its contacts 1–3 closed and its contacts 2–4 open, whereby a relay *r*1 for a first-speed timer is energized with direct current from a rectifier R1 through the closed contacts 1–3 of the microswitch MC.

A relay *r*3 is energized through a normally closed pair of contacts 1–2 of a contactor t1. Thus, through a pair of contacts 1–2 of relay r3 and the pair of contacts 1–2 of contactor *t*1 current is sent to a current rectifier R2 which excites a relay *r*2 for a second-speed timer.

Under these conditions, the motor M for operating the overwrapping machine is at a standstill.

When a manual pushbutton P1 is pressed, a relay *r*4 is excited through a manual pushbutton stop switch P2 and the relay stays self-excited through its pair of contacts 1–2 and the pushbutton stop switch P2. The excitation of the relay *r*4 causes, through its pair of contacts 3–4 and the contacts 1–3 of the microswitch MC, a relay *r*5 to be energized and to be supplied with direct current from the current rectifier R1.

The excitation of the relay r5 brings about, through its contacts 1–2 and the stop switch P2, the energizing of a contactor *t*4 which stays self-excited through its pair of contacts 1–2 and the stop switch P2.

When the packets to be fed to the overwrapping machine reach the microswitch MC they change over the position of its contacts from 1–3 closed and from 2–4 open.

At a time preset by a capacitor *c*1, this changeover causes the relay *r*1 to drop out and thus, through the pair of contacts 5–6 of the relay *r*4, self-excited as seen earlier on, the pair of contacts 1–3 of the relay *r*1 itself, the pair of contacts 1–2 of the energized relay *r*2 and the pairs of contacts 3–4 of the contact *t*2, to energize the contactor *t*1 and to set the motor M going at its first speed, through its pairs of contacts 7–8, 9–10 and 11–12. With the excitation of the contactor t1 its contacts 1–2 open and thus with the relay *r*3 dropping out, the supply to the rectifier R2 ceases and, consequentially, at the time preset by a capacitor *c*2, the relay *r*2 is de-energized. In this way the changeover occurs of the contacts of the relay *r*2 from position 1–2 to position 1–3 which results in the contactor *t*1 dropping out and the contactor t2 being energized through the pairs of contacts 5–6 of the relay *r*4, 1–3 of the relay *r*1, 1–3 of the relay *r*2 and 3–4 of the contactor *t*1 itself.

The excitation of the contactor t2 brings about the closing of its contacts 5–6, 7–8 and 9–10 and a change in the speed of the motor M from the first speed to the second speed, as well as the closing of the contacts 11–12, at the time preset by the capacitors *c*3 and *c*4, respectively, of the electromagnets 32 and 43, respectively, for the insertion in the operating cycle of the sealing members 29 in conformity with the present invention.

What is claimed is:

1. A device for sealing seams of thermoplastic overwraps on packets, comprising;

transferring means movable for transferring packets along a path at a plurality of operating speed levels subject to periodic halts, receptive during each halt of a packet and of a thermoplastic overwrap sheet at a first station for wrapping the packet in the sheet and thereby providing a seam between different portions of the sheet on the packet, the transferring means having a plurality of overwrap sealing stations spaced apart from the first station and from one another along said path;

a plurality of sealing contrivances, each located in a position adjacent to one of the sealing stations, all contrivances being mounted for movement relative to said seam, and each contrivance being mounted to effect said movement thereof into and away from contact with said seam, in the respective sealing station;

a plurality of supports, one for each sealing contrivance, for supporting it in said position and for effecting said movement;

a plurality of control cams, one for each support, each being movable in synchronism with the transferring means and each having linkage means for reciprocably shifting the respective support to effect said movement, during each halt of the transferring means; and means for tripping the linkage means of at least one of the control cams in response to changes of said speed levels to keep the total time of contact of the sealing contrivances with said seam substantially constant regardless of the changes of said speed levels.

2. A device according to claim 1, in which the plurality of sealing stations comprises two such stations equally spaced from the first station and from one another.

3. A device according to claim 1 including a single control cam shaft for moving the plurality of control cams.

4. A device according to claim 3 including a rotatable eccentric disc having a sleeve about it and a rod secured to the sleeve; the single control cam shaft having a lever secured thereto and linked to the rod for the moving of the control cams.

5. A device according to claim 1 in which the means for tripping the linkage means comprises an electromagnet and a biasing spring for each contrivance and control cam, each magnet being disposed to activate a connection between the respective cam and contrivance and each spring being disposed to inactivate said connection; and a circuit for activating and deactivating the magnets in response to various speed levels of the machine.

6. A device according to claim 1 in which at least one of the control cams has track means for providing the time of contact of the respective sealinng contrivance at a lowermost operating speed level during a halt of the transferring means.

7. A device according to claim 1, in which the transferring means is a rotatable wrapping wheel.

* * * * *